US005765262A

United States Patent [19]

Salice

[11] Patent Number: 5,765,262

[45] Date of Patent: Jun. 16, 1998

[54] HINGE FOR THE ARTICULATED CONNECTION OF TWO LEAVES OF A DOOR

[75] Inventor: Luciano Salice, Carimate, Italy

[73] Assignee: Arturo Salice, Novedrate, Italy

[21] Appl. No.: 745,225

[22] Filed: Nov. 8, 1996

Related U.S. Application Data

[63] Continuation of Ser. No. 520,036, Aug. 28, 1995, abandoned, which is a continuation of Ser. No. 219,628, Mar. 29, 1994, abandoned.

[30] Foreign Application Priority Data

Mar. 31, 1993 [DE] Germany ..... 43 10 626.9

[51] Int. Cl.[6] ..... E05D 11/10; E05D 7/04

[52] U.S. Cl. ..... 16/336; 16/236; 16/375

[58] Field of Search ..... 16/237, 238, 239, 16/240, 360, 375, 387, 389, 278, 282, 284, 286, 287, 370, 390, 382, 254, 336, 334, 335, 344

[56] References Cited

U.S. PATENT DOCUMENTS

| | | | |
|---|---|---|---|
| 4,157,599 | 6/1979 | Holmes | 16/278 |
| 4,873,743 | 10/1989 | Toyama | 16/237 |
| 4,976,006 | 12/1990 | Lautenschlager | 16/238 |
| 5,201,096 | 4/1993 | Dubach et al. | 16/389 |

FOREIGN PATENT DOCUMENTS

| | | | |
|---|---|---|---|
| 0463439 | 1/1992 | European Pat. Off. . | |
| 0468176 | 1/1992 | European Pat. Off. . | |
| 2460864 | 7/1975 | Germany | 16/375 |
| 8616321 | 11/1987 | Germany . | |
| 8710717 | 12/1989 | Germany . | |
| 4016664 | 11/1991 | Germany . | |
| 9203048.3 | 6/1992 | Germany . | |
| 4133343 | 2/1993 | Germany . | |

*Primary Examiner*—Chuck Mah
*Attorney, Agent, or Firm*—Morgan & Finnegan, LLP

[57] ABSTRACT

A hinge for the articulated connection of two leaves of a door, which are arranged to shut at an angle to each and of which one door leaf is pivoted to the body part of a piece of furniture or the like, comprises a cranked hinge arm able to be mounted on the body of the piece of furniture, and which is attached to a support plate, and a hinge part adapted to be secured to the other leaf and on which a free end of the hinge arm is pivoted. In order to provide such a hinge which is less complex to produce and has a high strength while being able to be fitted to leaves of a door of various different thicknesses, the part, able to be secured to the support plate, of the hinge arm comprises a standard hinge arm for conventional double link hinges, to which the pivot part, which is connected with the pivotal hinge part, of the hinge arm is attached.

5 Claims, 4 Drawing Sheets

HINGE FOR THE ARTICULATED CONNECTION OF TWO LEAVES OF A DOOR

This is a continuation of application Ser. No. 08/520,036, filed on Aug. 28, 1995, now abandoned which is a continuation of application Ser. No. 08/219,628, filed on Mar. 29, 1994, now abandoned.

FIELD OF THE INVENTION

The invention relates to a hinge for the articulated connection of two leaves of a door, which are arranged to shut at an angle to each and of which one door leaf is pivoted to the body part of a piece of furniture or the like, comprising a cranked hinge arm able to be mounted on the body of the piece of furniture, and which is attached to a support plate, and a hinge part adapted to be secured to the other leaf and on which a free end of the hinge arm is pivoted.

BACKGROUND OF THE INVENTION

Hinges of this type are described for instance in the German patent publication 9,203,048.3 U and the European patent publication 0 463 439 A. Such hinges are intended to be readily adapted to door leaves of different thickness in a simple manner. In the case of known hinges an adaptation to door leaves of different thickness is possible because the parts, bridging the gap between the door leaves, of the hinge arms are divided, are able to slide in a plane of separation, which extends perpendicularly to the plane bisecting the angle between the door leaves, and are then able to be clamped together in the positions set by sliding by a clamping screw. The known hinges not only require complex special manufacturing techniques, but are furthermore weakened because the hinge arms are able to be taken apart and must be clamped together by means of attachment screws.

One object of the present invention is consequently to provide a hinge of the type initially mentioned, which is less complex to produce and has a high strength while being able to be fitted to leaves of a door of various different thicknesses.

SUMMARY OF THE INVENTION

In accordance with the invention this aim is attained in the case of a hinge in accordance with the preamble of claim 1 since the part, able to be secured to the support plate, of the hinge arm comprises a standard hinge arm for conventional double link hinges, to which the pivot part, which is connected with the pivotal hinge part, of the hinge arm is attached. In principle every manufacturer of furniture hinges produces double link hinges in large production runs, in the case of which hinge arms able to be secured to support plates are pivotally connected by means of two links with pot-like hinge parts. Such double link hinges constitute the conventional hinge for hanging furniture doors in place. In accordance with the invention the hinge comprises a hinge arm available at every producer of furniture hinges for double link hinges with which a pivot part connected pivotally with the pivoting hinge part, of the hinge arm is fixedly connected. For the production of the hinge in accordance with the invention it is hence merely necessary to produce the pivoting hinge part and the pivot part, which is pivotally connected with the same, in a special production run and then to connect it with the mass produced hinge arm, i. e. the arm produced in a large production run. Accordingly the degree of complexity of production for the manufacture of the hinge in accordance with the invention is substantially reduced, because a part of the hinge arm is already available owing to conventional production of double link hinges.

The pivot part of the hinge arm is connected with the mass produced hinge arm so that there are no strength problems in connection with adjustability of the hinge arms. An adaptation to parts of door leaves with different thicknesses is achieved with the hinge in accordance with the invention since the conventional special forms of mass produced hinge arms are employed together with their support plates. In the case of conventional mass production of double link hinges different hinge arm configurations are produced, in the case of which the pivot holes of the mass produced hinge arms have different distances from the body parts, to which the same are attached by means of their support plates. A special adaptation of the pivoting hinge parts is unnecessary, since the adaptation to different thicknesses of the leaves is alone performed by the selection of the mass produced hinge arms and furthermore the associated support plates.

It is convenient if the pivot part of the hinge arm is connected with the mass produced arm by two pins, which extend through the pivot holes in the pivot part and the holes in alignment therewith in the pivot part. Such pins are then riveted in the same fashion in the pivot hole of the mass produced hinge arm, as is performed in the case of the production of double link hinges for providing a bearing for the links on the pins.

The mass produced or standard hinge arm can be mounted on conventional support plates, which render possible the setting of the hinge arm in at least one direction. Owing to this adjustability of the hinge arm on conventional support plates it is possible for a further adaptation and setting of the hinges to be performed.

It is convenient if the pivot part is bearinged in a pot-like hinge part. Furthermore there is conveniently only one pivot shaft as a bearing means for the pivot part. The pivot part can be provided with an abutment, bearing against one leaf, of synthetic resin, which delimits the minimum pivot angle between the two leaves.

In accordance with a preferred development of the invention there is a provision such that the pivot part is provided with a cam member concentric to the pivot shaft and a cam member adjoining the same by way of an outwardly directed step, on which cam member a spring-loaded pin runs which is parallel to the pivot shaft, and which makes such engagement with the step which the leaves shut at an angle to one another that the leaves are resiliently urged apart into such shut setting in which they are at an angle to one another. Preferably the pin is held by the scrolled end of a strip spring, whose other scrolled end is secured in a slot in the pivotal hinge part, the pin running in slots in side walls of the pivotal hinge part.

One embodiment of the invention will now be described in the following in more detail with reference to the drawings.

DETAILED DESCRIPTION OF THE FIGURES

Figure 1:
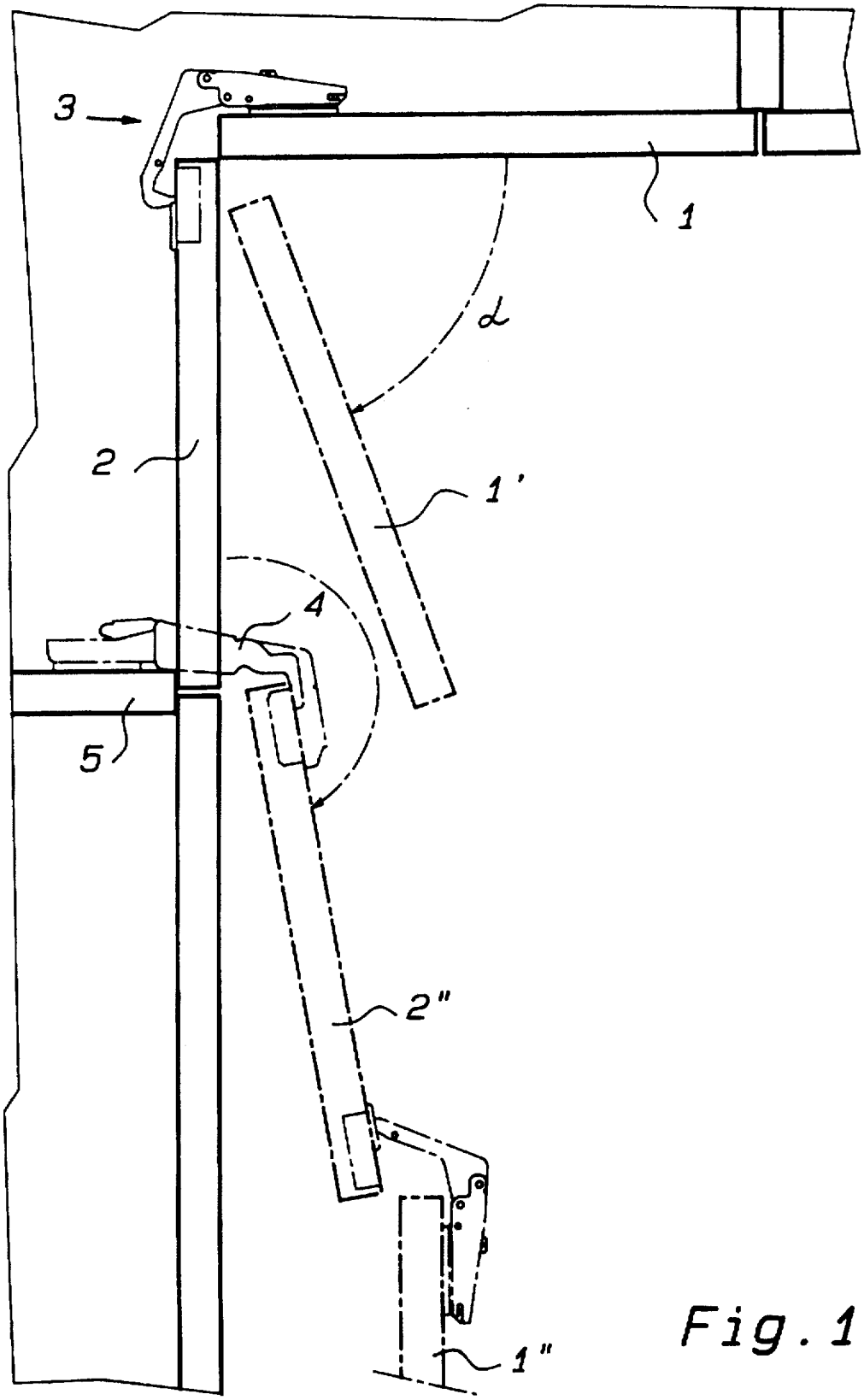
FIG. 1 is a plan view of two leaves connected together in a pivotal fashion by hinges, one of these leaves being pivotally connected by a wide angle hinge on a supporting wall of piece of furniture.

In FIG. 1 the reader will see a plan view of a corner cupboard, in the case of which the leaves 1 and 2 of the door leaves are located in their closed setting at a right angle to each other. In this respect the leaves 1 and 2 are connected with each other by at least two hinges 3 in accordance with the invention, the inner leaf 2 being connected by conventional wide angle hinges 4 with a support or load bearing wall 5 of the cupboard. For opening the corner cupboard it is possible firstly for the leaf 1 to be pivoted through the angle α into the position 1' as shown in chained lines, in which the leaves 1 and 2 are at the minimum angle to one another. In the lower part of FIG. 1 the leaves 1" and 2" will be seen in their completely opened position, in which the leaves are at an obtuse angle to one another.

The hinges 3 in accordance with the invention comprise a U-like standard or mass produced hinge arm 6, as is employed for the mass production of conventional double link hinges. This mass produced hinge arm is attached by means of a conventional support plate 7 to the leaf 1. The mass produced hinge arm 6 and furthermore the support plate 7 is of conventional design so that it is unnecessary to describe it here in detail. The support plate 7 preferably comprises a base plate and one or more intermediate plates, which are able to be shifted and/or pivoted in relation to each other and may relatively be locked in the settings which have been produced.

At its front end the mass produced hinge arm 6 has two respective aligned holes 8 and 9 in its lateral limbs which in the production of conventional double link hinges serve to receive the pivot pins on the hinge arm. In the illustrated working embodiment of the invention the holes 8 and 9 are in alignment with the holes in the cranked hinge arm 10 of the hinge arm so that the mass produced hinge arm 6 can be connected with the cranked hinge arm 10 by pins, which extend through the aligned holes in the mass produced hinge arm and in the pivot part and are riveted in the holes in the mass produced hinge arm.

Figure 6:
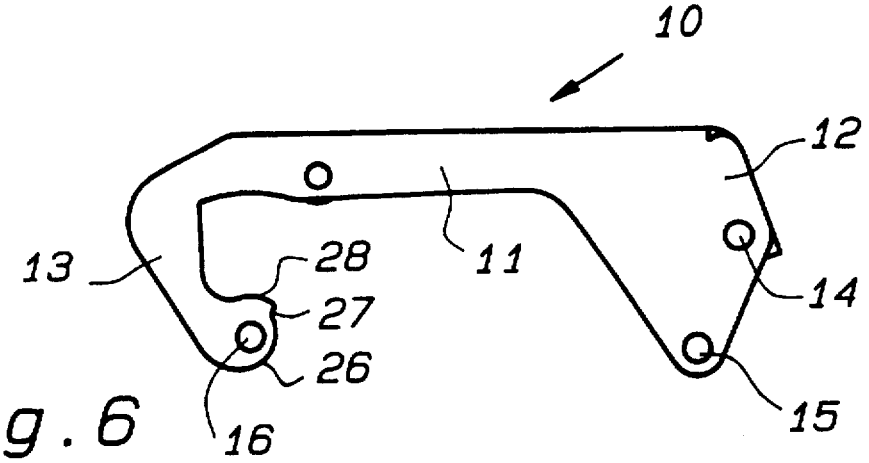
FIG. 6 is a lateral elevation of the pivot part of the hinge arm.
Figure 8:
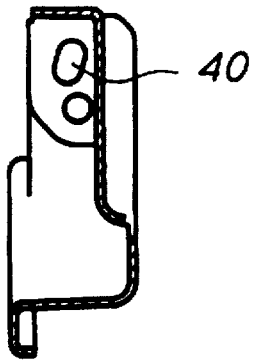
FIG. 8 is a section taken on the line VIII—VIII of FIG. 7 of the hinge pot.
Figure 7:
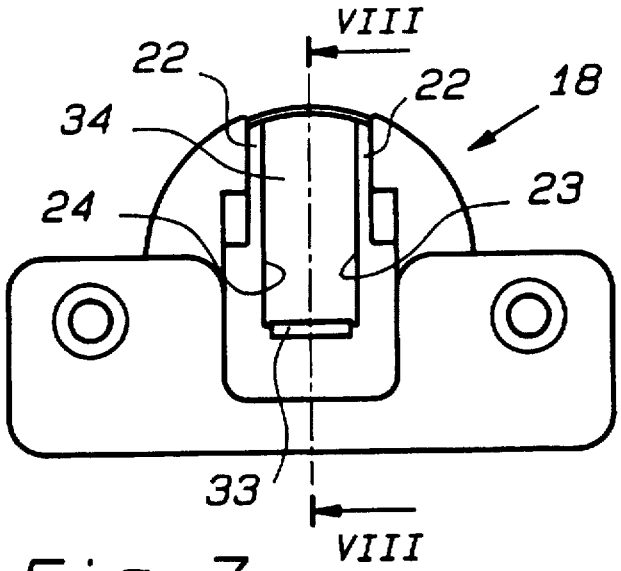
FIG. 7 is a plan view of the hinge pot.

The cranked hinge arm 10 of the hinge arm is multiply cranked or bent as may be best seen from FIG. 6 and possesses a substantially U-like configuration. The straight center part 11 of the pivot part possesses a U-like cross section. The center part 11 is adjoined by cranked, bifurcate terminal parts 12 and 13, the limbs of the bifurcate terminal part 12 being provided with holes 14 and 15, which are in alignment with the bearing holes 8 and 9 of the hinge arm 6. The bifurcate limbs of the end part 13 possess aligned holes 16, which serve as a bearing means for the pivot part using a pivot part 17 in the pot-shaped hinge part 18. Between the limbs of the straight center part 11 of the cranked hinge arm 10 a cylindrical section 20 of synthetic resin is held on a pin 19 and constitutes an abutment limiting the angle of opening.

The cranked, bifurcate ends 13 are bearinged in a recess 22 in the hinge pot 18 around the pivot part 17, the flat wall surfaces 23 and 24 of the recess 22 constituting guides for the cranked and bifurcate limbs 13.

The ends of the bifurcate limbs are provided with a cam part 26 concentric to the hole 16, and adjoined by a cam part 28 which merges with it at an outwardly directed step 27. On the cam 26, 27 and 28 a pin 30 runs which is parallel to the pin axis 17 and which is held in a scrolled end 32 of a cranked strip spring 31. The other, also scrolled end 32 of the strip spring 31 is held in a slot 33, which is located at the lower edge of a raised stage 34 constituting the floor of the pot-shaped hinge part 18. For fitting the pin 30 and the strip spring 31 in position it is merely necessary to hold the pin 30, placed in the strip spring, against the two guide edges of the cams 26, 27 and 28 and to so thrust the other limb of the strip spring 31 downwards that the other end 32 snaps into the retaining slot 33.

Figure 2:
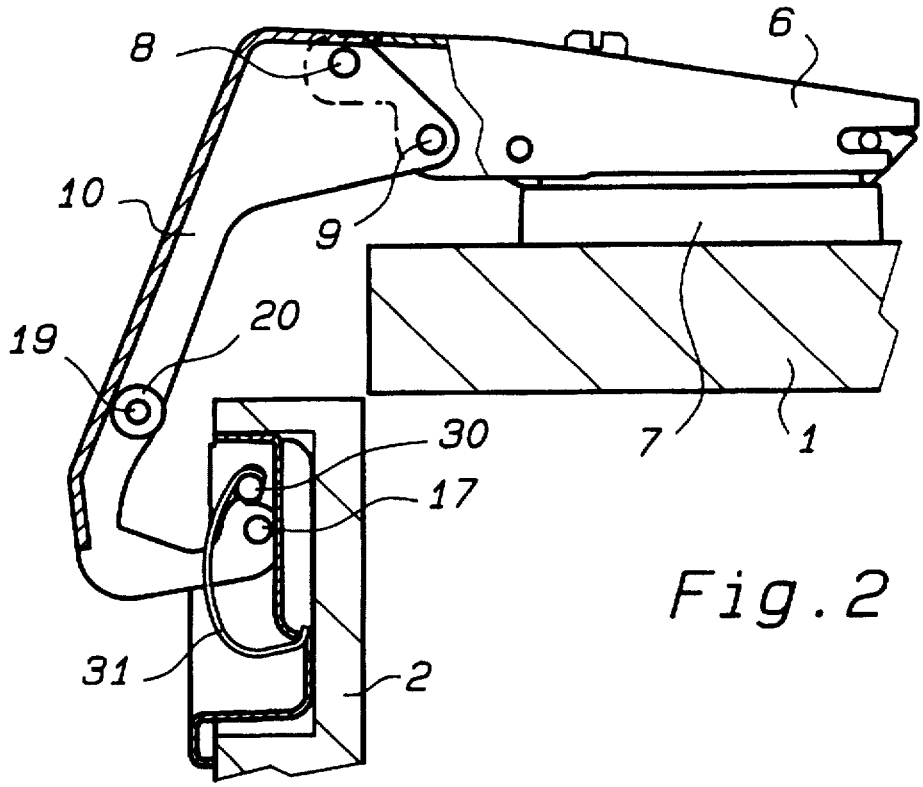
FIG. 2 shows a hinge connecting two leaves together partly in section and in a position, in which the leaves are in a closed position at a right angle to one another.
Figure 3:
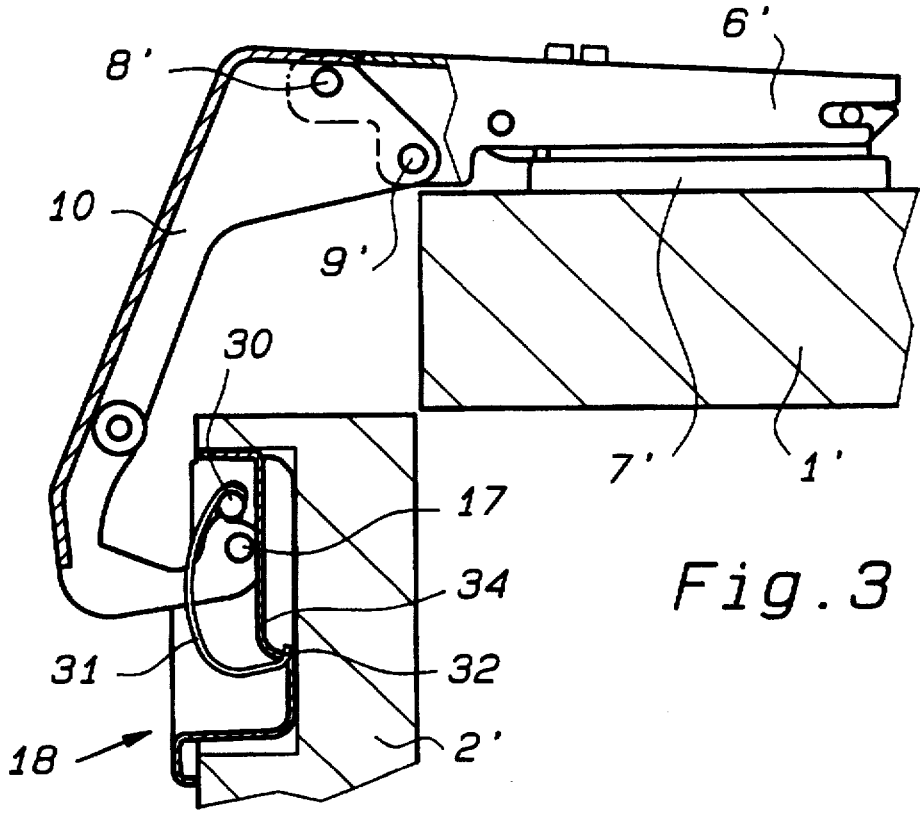
FIG. 3 is a representation corresponding to FIG. 2, in the case of which however the leaves have a greater thickness than the leaves in accordance with FIG. 2.
Figure 4:
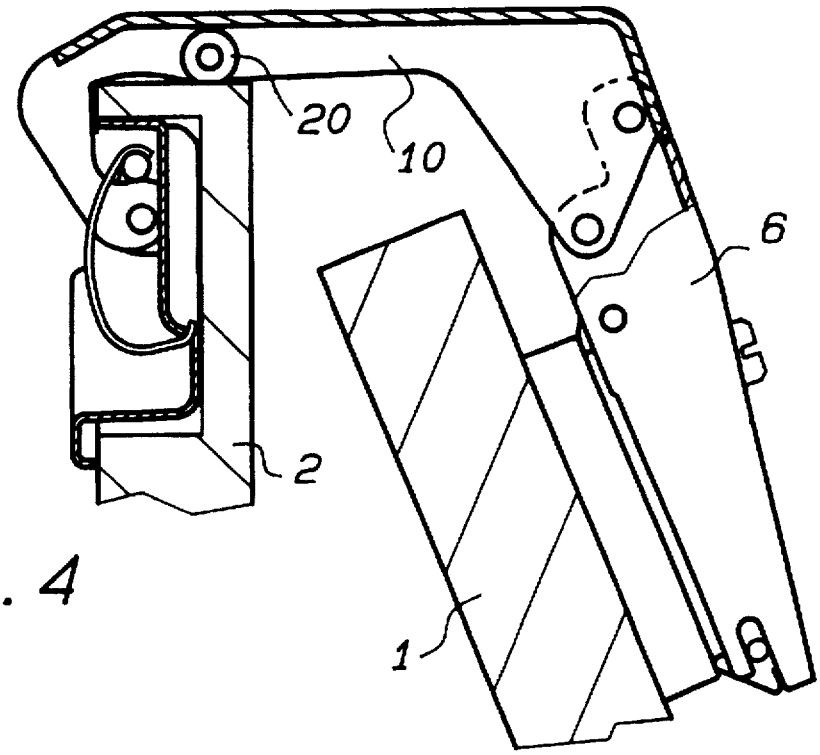
FIG. 4 is a showing corresponding to FIG. 2, in the case of which the leaves are at a minimum angle to each other.
Figure 5:
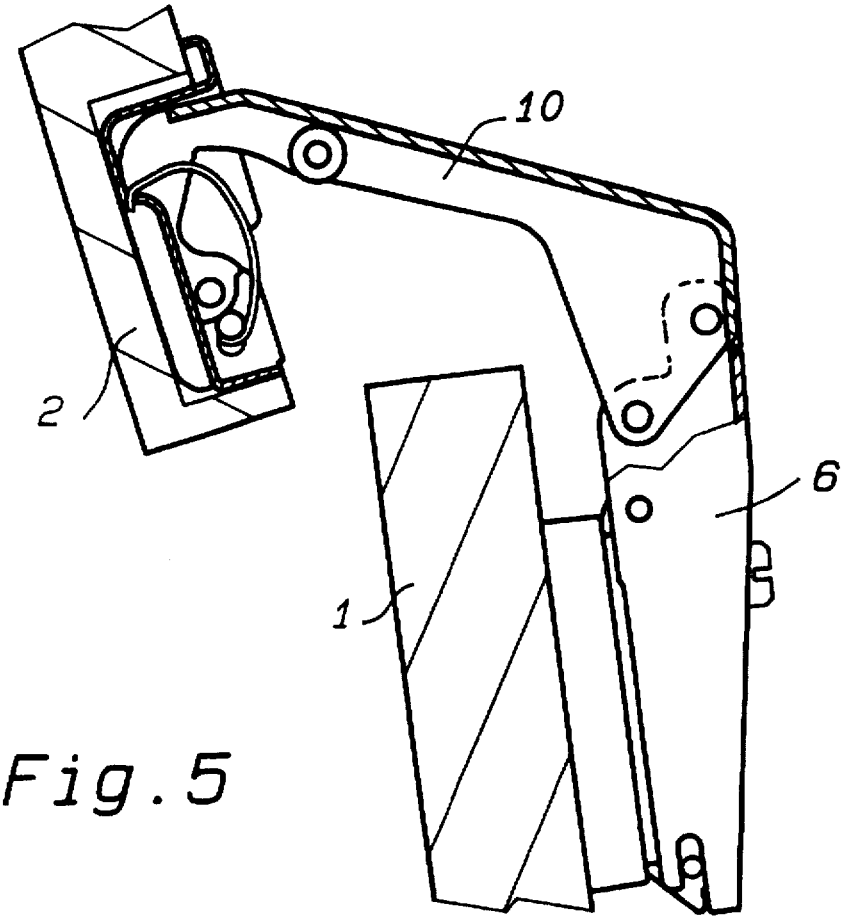
FIG. 5 is a representation corresponding to FIG. 2, in the case of which the leaves are in the open setting and are at the maximum angle in relation to one another.

The representation in accordance with FIG. 2 differs from the view of FIG. 3 in that the leaves 1' and 2' are thicker. In order to render possible assembly while still having the same dimensions of the cranked hinge arm 10 of the hinge arm in the case of the thicker leaves 1' and 2' in accordance with FIG. 3 use is made of a mass produced or standard hinge arm 6' with an associated support plate 7', in the case of which the pivot holes 8' and 9' are arranged nearer to the leaf 1' and extend further past the same. It will consequently be seen from FIGS. 2 and 3 that the hinge in accordance with the invention, while still having the same design of the pivot part and of the hinge part pivoted to it, can be adapted to various different thicknesses of leaf because different designs of mass produced or standard hinge arms are utilized with the respective support plate.

As shown in FIG. 2 in the closed setting the pin 30 loaded by the strip spring 31 abuts the step 27 in the cam so that the leaves 1 and 2 are resiliently urged towards their closed setting at a right angle. The pin 30 runs in slots 40 in the pot-shaped hinge part 18 so that it may perform the necessary compensatory movement as it slides over the step 27.

The strip spring 31 itself is arranged between the bifurcate limbs of the end part 13 of the cranked hinge arm 10.

I claim:

1. A hinge for an articulated connection of a first door leaf and a second door leaf of a door, wherein the first door leaf and the second door leaf are arranged to shut at an angle to each other, and the first door leaf is pivoted to a body part of a piece of furniture, said hinge comprising a hinge arm (6) attachable to the second door leaf by means of a support plate (7, 7'), a cranked pivot part (10) rigidly connected with the hinge arm (6) by means of two pins, said pins extending through pivot holes (8, 9) of said hinge arm (6) and holes in alignment therewith in the cranked pivot part (10), said pivot part (10) being pivotable about a pivot axis (17) and being securable to the first door leaf, wherein the pivot part (10) is pivotable in a plane perpendicular to the pivot axis (17) of said pivot part (10) and pivot part (10) is bearinged in a pot-shaped hinge part (18).

2. The hinge as claimed in claim 1, wherein the pivot part (10) is pivotally mounted for pivoting about a single pivot axis (17).

3. The hinge as claimed in claim 1, wherein the pivot part (10) is furnished with an abutment (20) of synthetic resin which limits an angle of opening of said second door leaf.

4. The hinge as claimed in claim 1, wherein the pivot part (10) is provided with a first cam member (26) concentric to said pivot axis (17) and with a second cam member (28) adjoining the first cam member (26) by way of an outwardly directed step (27), on which cam members a spring loaded pin (30) parallel to the pivot axis (17) runs, the pin so abutting the step (27) in the closing range of the leaves (1 and 2) so that said leaves (1 and 2) are urged into a closed setting in which they are at an angle to each other.

5. The hinge as claimed in claim 4, wherein the pin (30) is held by the scrolled end of a bent strip spring (31), whose scrolled curved end (32) is secured in a slot (33) in the pot-shaped hinge part (18) and runs in slots (40) in lateral walls of a pot-shaped hinge part (18).

* * * * *